US005466992A

United States Patent [19]

Nemirow et al.

[11] Patent Number: 5,466,992

[45] Date of Patent: Nov. 14, 1995

[54] INVERTER BALLAST CIRCUIT FEATURING CURRENT REGULATION OVER WIDE LAMP LOAD RANGE

[75] Inventors: Arthur T. Nemirow, Silver Springs; James C. Harper, Reno, both of Nev.

[73] Assignee: Bruce Industries, Inc., Dayton, Nev.

[21] Appl. No.: 932,708

[22] Filed: Aug. 19, 1992

[51] Int. Cl.[6] ..... H05B 41/16

[52] U.S. Cl. ..... 315/276; 315/278; 315/219; 315/105; 315/DIG. 5

[58] Field of Search ..... 315/276, 278, 315/219, DIG. 7, DIG. 5, 94, 95, 98, 105; 336/155, 170; 331/113, 114 A

[56] References Cited

U.S. PATENT DOCUMENTS

| | | | |
|---|---|---|---|
| 3,389,299 | 11/1966 | Bell | 315/DIG. 7 |
| 3,448,335 | 7/1966 | Gregory | 315/160 |
| 5,124,619 | 6/1994 | Moisin et al. | 315/219 |
| 5,191,263 | 3/1993 | Konopka | 315/219 X |
| 5,214,355 | 5/1993 | Nilsser | 315/219 |
| 5,237,243 | 8/1993 | Chung | 315/219 |

*Primary Examiner*—Robert J. Pascal
*Assistant Examiner*—Reginald Ratliff
*Attorney, Agent, or Firm*—Beehler & Pavitt

[57] ABSTRACT

A ballast circuit for driving fluorescent lamps characterized by a minimum of components has a power transformer constructed to present a source impedance integrated with the transformer and in series with the lamp load sufficient to regulate the load current to within 10% for a selected maximum wattage fluorescent lamp load, such as 18 or 36 watt, and any lesser fluorescent lamp loads. The transformer has a high voltage secondary winding with a reflected impedance at least 6.0 times greater than the reflected impedance of the selected worst case fluorescent lamp wattage load. The integrated magnetics design of this ballast also provides passive short circuit protection, filament current reduction after lamp strike, and cold temperature start-up with a minimum of circuit components.

10 Claims, 4 Drawing Sheets

T1
L1-L2
L3-L6
12
14
16
18
20
22
24
26
28
30
30A
32
1
2
3
4
5
6
7
8
9
10
11

Fig. 6
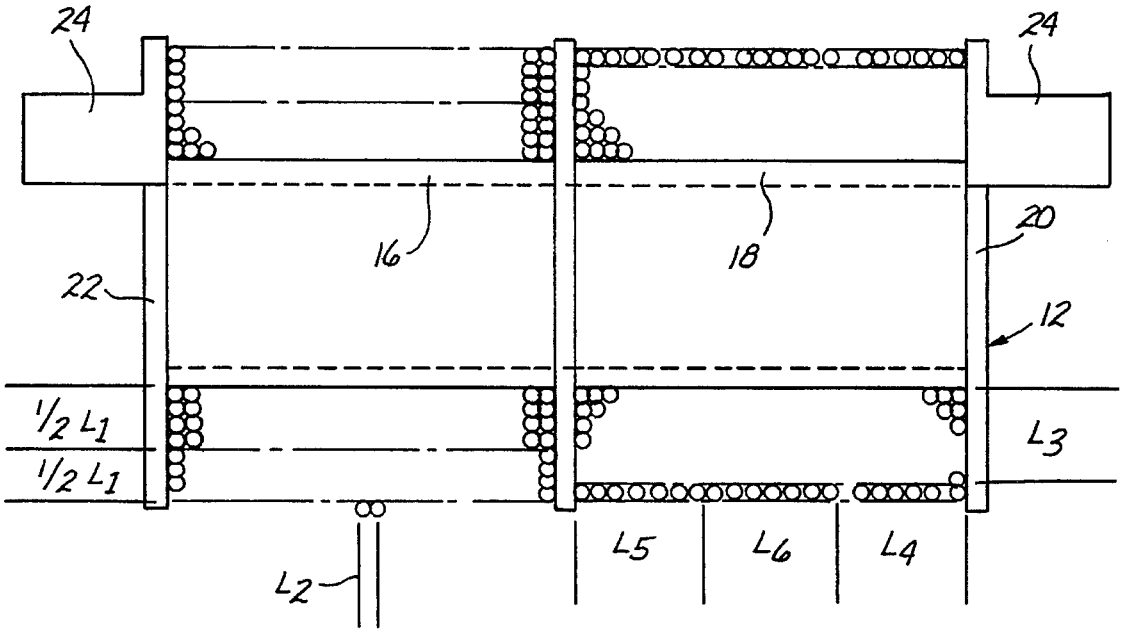
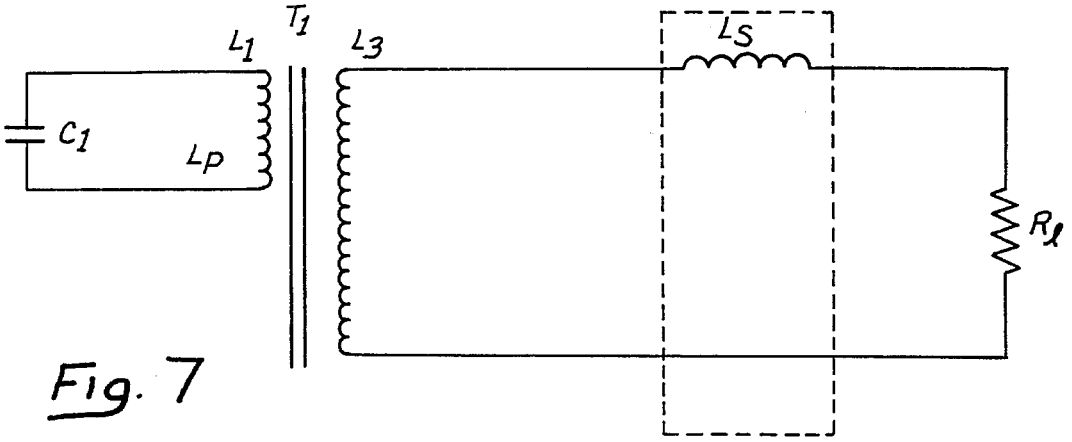
Fig. 7
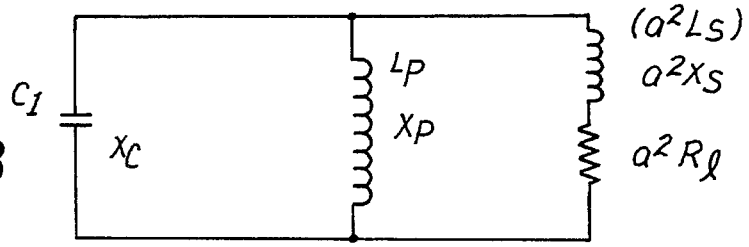
Fig. 8

INVERTER BALLAST CIRCUIT FEATURING CURRENT REGULATION OVER WIDE LAMP LOAD RANGE

BACKGROUND OF THE INVENTION

1. Field of the Invention

This invention relates to the field of fluorescent lighting and more particularly is directed to a fluorescent lamp ballast characterized by superior load current regulation such that one ballast can run lamp loads of a wide wattage range while maintaining approximately constant current through the lamps.

2. State of the Prior Art

Fluorescent lamps are low pressure mercury arc discharge devices. A filament at each end of a sealed lamp tube is heated by a filament current, and a glow discharge is sustained between the electrodes by a sufficiently high lamp voltage applied across the lamp tube. Such a fluorescent lamp behaves as a negative impedance in that, as current increases through the lamp its resistance drops. Unless externally limited the current will rise until the lamp is destroyed. A ballast is designed to supply the necessary lamp and filament voltages while limiting the current to the lamp at a level which provides optimum light output without damaging the lamp tube. A ballast is essentially a voltage source which feeds a current limiting reactive component in series with the lamp load. One type of voltage source used for this purpose is an LC resonant tank circuit, while the current limiting component is the internal leakage inductance of a transformer used to convert the resonant tank voltage to the higher lamp voltage and lower filament voltages.

One specially demanding ballast application is in fluorescent lighting of aircraft cabins, such as in passenger jetliners. Aircraft lighting systems must meet requirements of low weight, small size and a minimum of electromagnetic interference (EMI). Small size and light weight is achieved by minimizing the number of components used, and specially by minimizing the number and size of the magnetic components. Some ballasts achieve the objective of low EMI by operating at low AC frequencies, such as 60 cycle or 400 cycle AC. Inductors and capacitors required by low frequency ballasts tend to be bulky and heavy, however. High frequency operation, e.g. 20 to 30 Kilohertz, alleviates this shortcoming. High frequency ballasts are more prone to generate EMI however, and the circuit must be designed to minimize this problem.

Existing high frequency ballasts are designed to regulate the output current (thus regulating the lamp light output) for a particular fluorescent lamp load, i.e. one or more lamps of a given total wattage. If used with loads of greater or lesser wattage, the current through the lamp is substantially greater or lesser than optimal for that particular load. Too large a current shortens lamp life, while insufficient current may cause the lamp to flicker.

What is needed, particularly for aircraft applications, is a universal ballast capable of regulating load current for a range of fluorescent lamp loads, for example from 18 Watts to 4 Watts, or even from 36 Watts to 4 Watts, while holding the load current approximately constant. Such a universal ballast should have a minimum of components and particularly a minimum of heavy inductors or bulky capacitors to minimize size and weight. The current and voltage delivered to the lamp should be sinusoidal in waveshape to minimize EMI.

SUMMARY OF THE INVENTION

The present invention addresses the aforementioned need by providing a ballast for fluorescent lamps characterized by an integrated magnetics ballast transformer optimized for enhancing the leakage inductance of the high voltage secondary winding so as to effectively place a large impedance in series with the lamp load, thereby achieving passive regulation of load current over a wide range of lamp loads without resorting to additional current limiting components or complex current regulating circuits. The integrated magnetics design also provides lamp and filament short circuit protection, filament current reduction upon striking of the lamp load, and cold ambient temperature start-up, all in a circuit of simple design and compact assembly.

The universal ballast provides a power supply to a lamp load including a filament power supply for heating cathode filaments of a fluorescent lamp load and a high voltage power supply for striking the fluorescent lamp load, the power supply having a source impedance in series with the lamp load of a magnitude sufficient to regulate, the current through the load to about 10% or better for a selected maximum wattage fluorescent lamp load and any lesser fluorescent lamp loads. The high voltage supply includes a voltage step-up transformer, and the source impedance of the high voltage supply, i.e. the lamp current limiting inductance, is preferably integrated with the transformer to minimize component count and EMI. The power supply includes a push-pull transistor drive circuit self-resonant at a start-up frequency of the ballast and a higher resonant frequency in an operative, struck condition of the lamp load. This frequency shift, in conjunction with lamp current being established, causes the voltage drop across the transformer leakage inductance to increase. Thus, the filament power supply delivers a higher warm-up voltage to the filaments at the start-up frequency, and then a lower operating voltage to the filaments in the struck condition of the lamp load. In this manner lamp filament lifetime is improved. The novel ballast is further characterized in that the load current supplied to the fluorescent lamp or lamps is limited to manageable levels in a short circuit condition of either the lamp filaments or the fluorescent lamp load.

More particularly, the universal ballast of this invention includes a transformer having primary and secondary windings, a capacitor in parallel with the primary to form a resonant tank circuit, a two transistor drive circuit for converting a DC input to AC at the resonant frequency of the tank circuit, the secondary winding including a high voltage winding and filament windings, and magnetic cores coupling the primary and secondary windings. The ballast is characterized in that the magnetic cores and the windings are physically constructed, configured and arranged to achieve a reflected leakage impedance of the high voltage winding which is greater by a factor of at least 6.0 than the reflected impedance of a worst case fluorescent lamp load wattage, thereby to maintain approximately constant the lamp load current for the worst case lamp load and any lesser lamp loads. The reflected impedance may be enhanced by winding both the primary winding and the high voltage winding so as to maximize the number of wire turns on each winding. In particular, the high voltage winding has a number of turns substantially greater than required to produce a voltage sufficient to strike the worst case fluorescent lamp load. In a preferred form of the invention, each of the primary and secondary windings are mounted on a corresponding one of two magnetic E-cores joined end to end for coupling the primary and secondary windings. The axial spacing between the primary and secondary windings on the magnetic cores may be adjusted to an extent sufficient to achieve the desired reflected leakage inductance.

One presently preferred practical method for achieving the sufficient ratio of reflected leakage inductance of the high voltage winding involves the steps of 1) winding a ballast transformer with a high voltage secondary open circuit voltage greater than required to strike the lamp load, 2) connecting the ballast to a selected worst case fluorescent lamp load, 3) measuring the lamp current, 4) adjusting the number of turns on the primary and high voltage secondary windings while maintaining constant the turns ratio between the two windings until the desired lamp current is achieved, and 5) measuring the ratio of reflected secondary winding impedance to reflected lamp load impedance. If the ratio is less than the target figure, e.g. 8.0, then the high voltage secondary to primary turns ratio is increased and the process repeated beginning at step 2, until the target ratio is met or exceeded.

These and other features, advantages and characteristics of the present invention will be better understood from the following detailed description of the preferred embodiments and the accompanying drawings.

BRIEF DESCRIPTION OF THE DRAWINGS

FIG. 6 is a longitudinal section of the bobbin in FIG. 4 showing the various windings of the ballast transformer;

FIG. 7 is a simplified equivalent circuit showing the resonant tank on the primary side of the ballast transformer and the leakage inductance of the high voltage winding in series with the lamp load;

FIG. 8 is a simplified equivalent circuit of the resonant tank circuit showing the reflected leakage inductance of the a) high voltage winding leakage inductance and b) the lamp load impedance in series with each other and in parallel with the primary winding of the transformer;

DETAILED DESCRIPTION OF THE PREFERRED EMBODIMENT

I. Ballast Circuit Description

Figure 1:
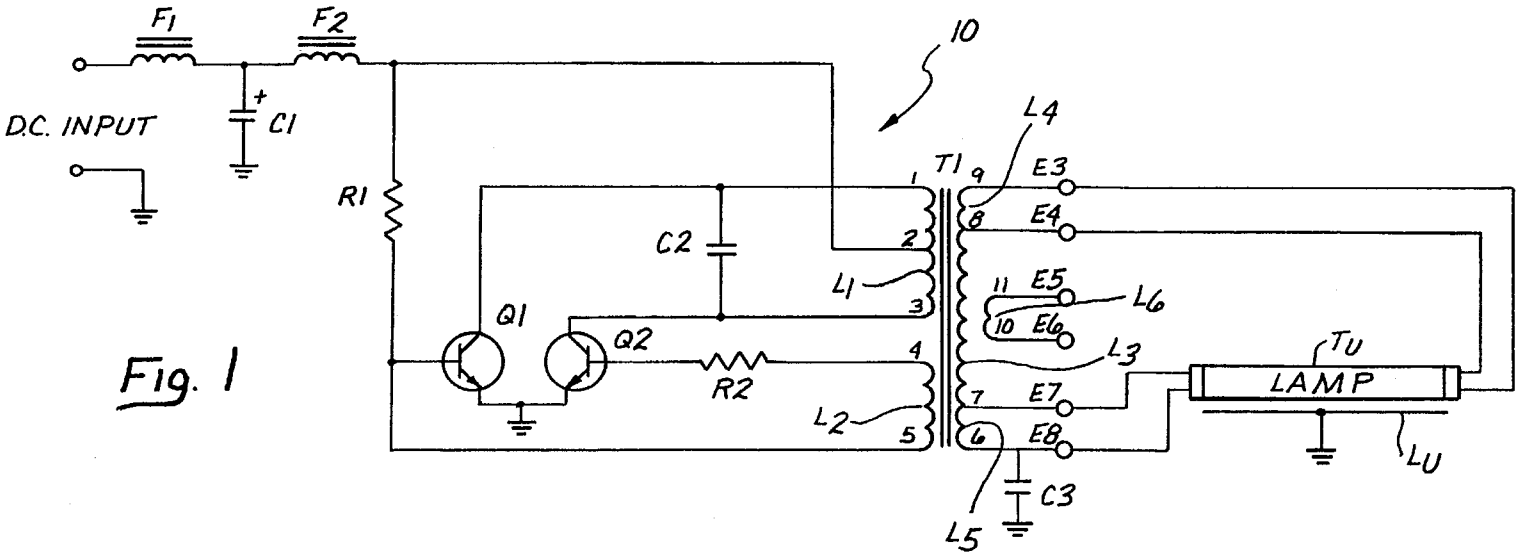
FIG. 1 is a circuit diagram showing the universal ballast of this invention connected for powering a single fluorescent lamp tube.
Figure 2:
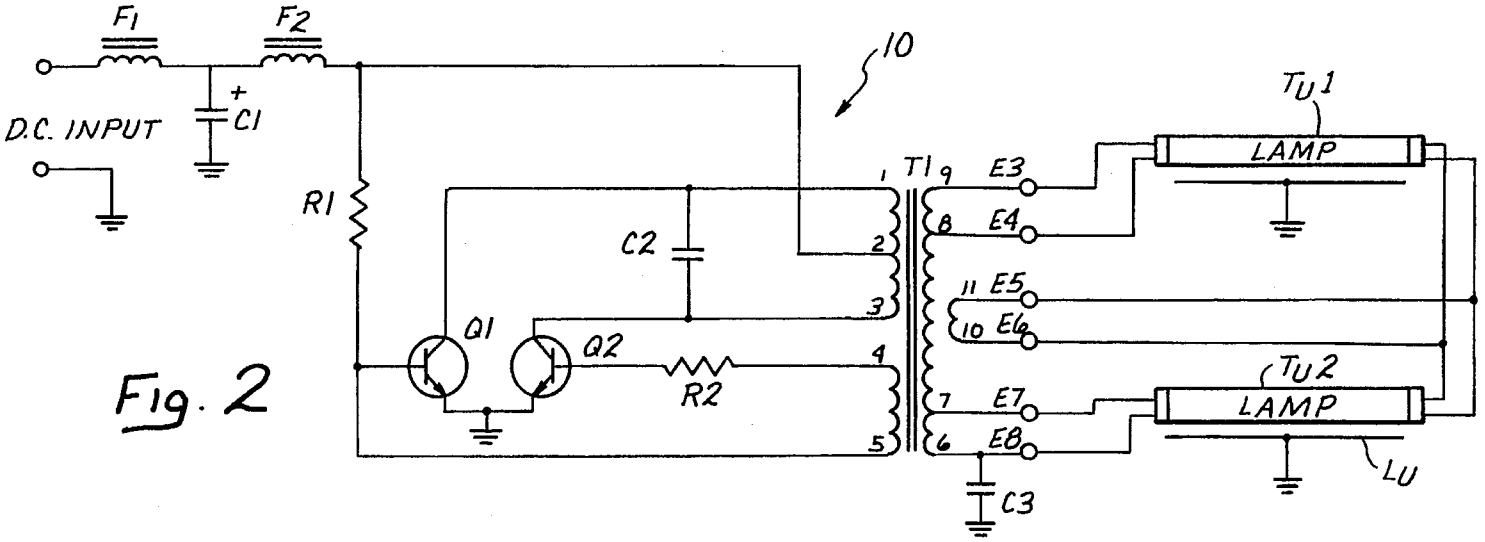
FIG. 2 shows the circuit of FIG. 1 connected for powering a pair of fluorescent lamp tubes.

With reference to FIGS. 1 and 2 of the accompanying drawings, the ballast circuit generally designated by the numeral 10 has a ballast transformer T1 with a center tapped primary winding L1 and a tertiary or control winding L2. Capacitor C2 and primary winding L1 form a parallel resonant LC tank circuit. The values of L1 and C2 given in the Parts List below are chosen to produce a resonant frequency of approximately 28 Kilohertz. Transistors Q1, Q2, inductor F2, resistors R1, R2 and control winding L2 form a self-resonant driver operating in phase with the tank circuit $L_1C_2$ to form a current driven inverter. The transistors are oppositely phased relative to each other, with a short dead time between the active phases of the two transistors. DC input power is supplied to the circuit through an EMI filter coil F1. Shunt capacitor C1 prevents current spikes generated by the resonant circuit from being passed on to the D.C. input. Inductor F2 holds the input current to the transformer center tap constant during the time that Q1 or Q2 are on, while the voltage is forced to change polarity. Transformer T1 has secondary windings including high voltage winding L3, two filament windings L4, L5 connected in series at opposite ends of the high voltage winding L3, and a separate, third filament winding L6. A fluorescent lamp tube Tu has a filament (not shown) at each end of the tube, each filament powered by one of the filament windings L4, L5 so that the lamp tube is connected between the opposite ends of the high voltage winding L3.

In FIG. 2, the ballast circuit 10 of FIG. 1 is shown connected for powering a pair of fluorescent lamp tubes Tu1 and Tu2. The two lamp tubes each have one filament connected to the third filament winding L6, which supplies these filaments in parallel. The remaining filament of each lamp tube is each connected to one of the filament windings L4, L5, such that the two lamp tubes are in series with each other and connected between the opposite ends of the high voltage winding L3. The components of the ballast circuit in FIGS. 1 and 2 are listed in the following Table 1.

TABLE 1

| Parts List | |
|---|---|
| F1, F2 Powdered Iron Toroid inductor 300 uH | |
| R1 2 KOhm/1W | R2 10 Ohm 1/4W |
| C1 470 uF/50V | C2 0.22 uF/400V |
| Q1, Q2 Motorola NPN Transistor MJE15030 | |

II. Ballast Transformer Construction

Figures 3, 4, 5:
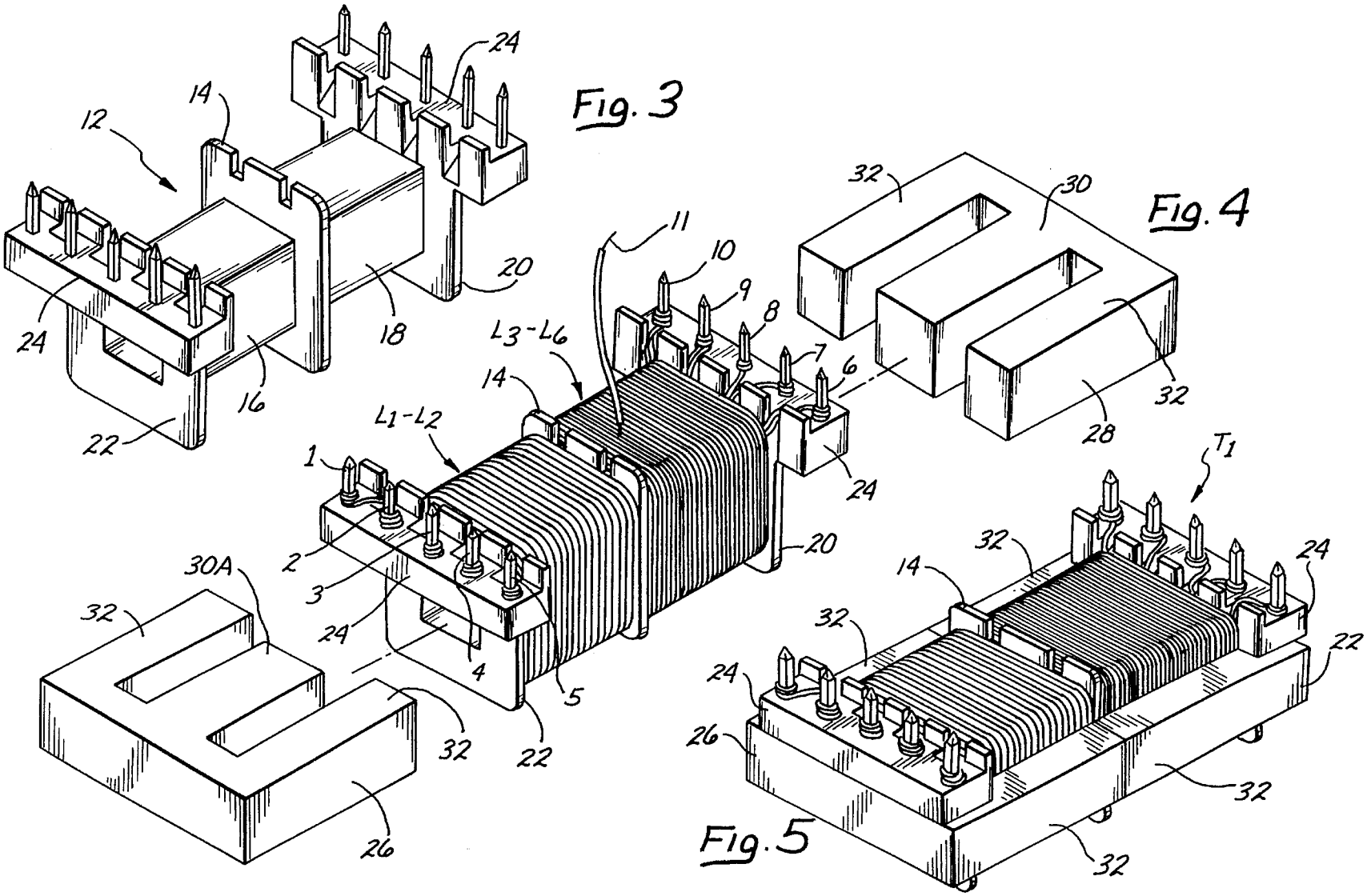
FIG. 3 is a perspective view of a bobbin on which is wound the transformer of the universal ballast of this invention.
FIG. 4 shows primary and secondary windings on the bobbin of FIG. 3, and a pair of magnetic E-cores in exploded relationship to the transformer bobbin.
FIG. 5 is a perspective view of the assembled ballast transformer.

The construction of the ballast transformer T1 and the transformer windings L1–L6 will now be described with reference to FIGS. 3–6. FIGS. 3 and 4 show a bobbin 12 of rectangular cross section divided by a center partition 14 into bobbin sections 16 and 18 between opposite end plates 20 and 22, with a terminal strip 24 on each end plate.

Bobbin section 16 carries the primary winding L1 and control winding L2, while bobbin section 18 carries the high voltage winding L3, and filament windings L4, L5 and L6. All windings are terminated at wire-wrap pins on the terminal strips 24. The numbering of the terminal pins in FIG. 4 corresponds to the winding output numbering in the circuit diagram of FIGS. 1 and 2. The bobbin 12 is mounted on and between a pair of magnetic E-cores 26, 28, each core with a center fingers 30, **30*a* and two outside fingers 32 as shown in the exploded view of FIG. 4. Center finger 30*a* is ground down 0.035 in. to produce a magnetic core gap of 0.035 when the cores 26, 28 are assembled together. This gap prevents magnetic saturation of the cores. The E-cores are joined end-to-end at the free ends of the fingers, such that the center fingers 30 slide into opposite open ends of the bobbin 12, while the outer fingers 32 and the back of the E-cores define a rectangular frame about the bobbin 12 and the windings. FIG. 5 shows the assembled ballast transformer T1 of FIGS. 1 and 2**.

The layering and arrangement of the transformer windings L1–L6 are best understood from the longitudinal cross section of the bobbin 12 in FIG. 6. Bobbin dimensions and winding specifications are listed in the following Table 2.

TABLE 2

| Ballast Transformer Windings | |
|---|---|
| Bobbin width | 0.36 inches |
| Length of each bobbin section 16, 18 | 0.63 inches |
| L1 | 46 Turns 75 × 40 Litz wire center tapped |
| L2 | 2 Turns 31K2 wire |
| L3 | 525 Turns 31K2 wire |
| L4 | 7 Turns 26K2 wire |
| L5 | 7 Turns 26K2 wire |
| L6 | 6 Turns 26K2 wire |
| E-Cores | E-section of Siemens B66217 power transformer N41 ferrite core, center leg of one Encore ground to make 0.035" gap |

The number of turns on the high voltage secondary L3 is considerably greater than needed to obtain the voltage required to strike the fluorescent lamp load Tu1 or Tu2,Tu3. The additional turns are provided to maximize the leakage inductance of the secondary winding for a given size bobbin 12. This is done by filling the secondary bobbin section 18 with as many turns of wire for L3 as will fit on the bobbin, as seen in FIGS. 5 and 6. Reflected leakage inductance is enhanced by using thin gauge wires consistent with the power dissipation needs of the L3 winding. The actual voltage output of L3 is regulated and limited by the strike voltage of the lamp load, however, and thus L3 never develops the full voltage possible by the turns ratio of transformer T1, unless the lamps are removed. The primary bobbin section 16 is also filled with as many turns of wire as possible to make the primary winding L1, which however is wound of thicker wire resulting in fewer turns than secondary winding L3, to maintain an appropriate voltage step-up ratio between these windings. The large number of wire turns on each of the two bobbin sections 16, 18 operates to maximize the leakage inductance of the secondary windings reflected unto the primary winding to achieve the integrated magnetics implementation of T1, from which derive the several benefits, features and advantages described herein with a minimum number of components in the ballast circuit. The reflected leakage inductance of transformer T1 is additionally enhanced by using relatively long E-cores 26, 28 and a relatively elongated transformer bobbin 12. This allows the reflected leakage inductance to be enhanced by elongating the primary and secondary windings i.e. by axially spreading out the windings. This is contrary to conventional transformer winding practice which seeks to minimize reflected leakage inductance, by for example interleaving the primary and secondary windings on a single bobbin.

III. Ballast Operation

Each winding on the secondary side of transformer T1 has a characteristic leakage inductance $L_w$ and leakage impedance $X_w$ which are respectively reflected onto the primary winding L1 as a reflected inductance $a^2L_w$ and reflected impedance $a^2X_w$, where a is the ratio of turns on the primary L1 to turns on the particular secondary winding. This leakage inductance and impedance is reflected in parallel with the transformer primary winding L1. In the case of the filament windings L4–L6, the value of $a^2$ is large (about 40 for the windings in Table 2 above) which causes the reflected filament winding leakage inductance to be large relative to the inductance of the primary winding. Since these two inductances are in parallel, the overall inductance and consequently the resonant frequency of the tank circuit $L_1C_2$ is largely determined only by C2 and L1, and the reflected inductance of the filament windings is negligible for practical purposes.

In an initial, start-up condition of the ballast 10 the AC voltage in the tank circuit $L_1C_2$ is stepped down on the filament windings L4–L6 to a suitable filament voltage, e.g. 4 volts rms for T5 type fluorescent lamp tubes, which heats the filaments to operating temperature in about 200 milliseconds, providing the conditions prerequisite for striking of the lamp load Tu1 or Tu2, Tu3 by the high voltage winding L3. Once struck, current flows through the lamp load to produce the light emitting arc discharge. Since voltage and current are in phase through the lamp tube, the lamp may be modelled as a resistive impedance as far as its effect on the resonant tank circuit $L_1C_2$. FIG. 7 is an equivalent circuit showing the leakage inductance $L_s$ of the high voltage winding L3 in series with the resistive impedance $R_1$ of the lamp load. Both the leakage inductance $L_s$ of L3 and the lamp impedance $R_{1_}$ are reflected to the primary winding L1, as shown by the equivalent circuit of FIG. 8. The reflected resistive impedance $a^2R_1$ of the lamp load is in series with the reflected leakage impedance $a^2X_s$ of L3 and both of these are in parallel with the impedance $X_p$ of primary winding L1. The value of $a^2$ for the high voltage winding L3 is small, on the order of 0.007, and consequently the reflected impedance $a^2X_s$ of L3 greatly changes the overall impedance Z of the resonant circuit $L_1C_2$ according to the equation $$Z=\frac{1}{\frac{1}{X_p}+\frac{1}{a^2X_s}} \quad \text{for } a^2X_s >> a^2R_1$$

and thus significantly shifts the LC resonant frequency.

Typical values for the circuit of FIG. 7 are:

Lp=271 uH

C2=0.23 uF $R_1$=1.0 KOhm (computed by dividing lamp voltage of 132V by rated lamp current of 132 mA, for an 18 Watts lamp load) The value of $X_s$, the leakage inductance of L3, is determined empirically by measuring the resonant frequency shift of $L_1C_2$ which occurs after the lamp load strikes. This frequency shift is typically from 28 Kilohertz down to 20 Kilohertz for the LC values and transformer windings given above. It can be shown that the effect of the reflected lamp impedance $a^2R_1$ on the resonant frequency shift is negligible for practical purposes, and that the resonant frequency shift is essentially caused by the reflected leakage inductance $a^2X_s$. The calculation of $X_s$ is as follows:

A. For an unstruck lamp load the resonant frequency $f_{starting}$ is:

$$f_{starting} = \frac{1}{2\pi\sqrt{L_p C_1}} = \frac{1}{2\pi\sqrt{271\times10^{-6}\cdot 0.23\times10^{-6}}}$$
$$= 20.2\text{ kHz}$$

B. For a struck lamp load the actual resonant frequency $$f_{operating} = 28.0\text{ KHz} = \frac{1}{2\pi\sqrt{L_{eff}C_1}}$$

$$L_{eff} = \frac{1}{4\pi^2 C_1 f_{operating}^2} = \frac{1}{4\pi^2(0.22\times10^{-6})(28\times10^3)^2}$$
$$= 147\text{ uH}$$

C. The effective inductance $L_{eff}$ of the resonant tank LC shifted from 271 uH for the unstruck lamp load to 147 uH for the struck lamp load. Since $L_{eff}$=($a^2L_s$ in parallel with $L_1$), the reflected leakage inductance of the high voltage secondary L3 may be calculated as follows:

$$L_{eff} = \frac{(a^2L_s)L_p}{a^2L_s + L_p} = \frac{a^2L_p}{1+\frac{a^2L_s}{L_p}}$$

$$a^2L_s = \frac{1}{\frac{1}{L_{eff}} - \frac{1}{L_s}} = \frac{1}{\frac{1}{147\ \mu H} - \frac{1}{271\ \mu H}} = 321\ \mu H$$

Figure 9:
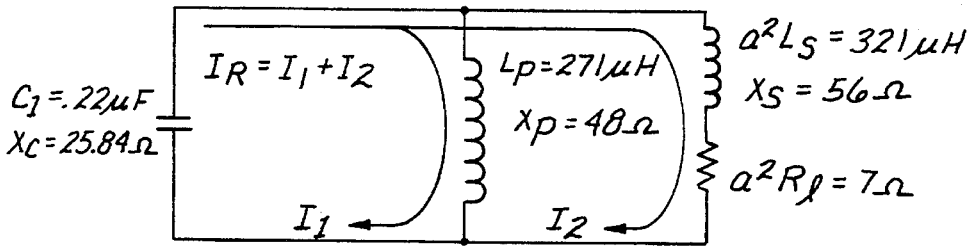
FIG. 9 shows the resonant current paths in the equivalent circuit of FIG. 8.

Therefore, with the lamp load struck, the equivalent circuit values for this example are as shown in FIG. 9 and the following Table 3:

TABLE 3

| |
|---|
| $C_1$ = .22 uF |
| $X_c$ = 25.84 Ohms |
| $L_p$ = 271 uH |
| $X_p$ = 48 Ohms |
| $a^2L_s$ = 321 uH |
| $X_s$ = 56 Ohms |
| $R_1$ = 1 KOhm (18 Watts lamp) |
| $a^2R_1$ = 7 Ohm |

At resonance the impedance $X_c$ of capacitor C2 is equal to the combined parallel impedances $X_p$ of the primary winding L1 and $a^2X_s$, the reflected leakage inductance of L3. The resonant current $I_R$ in the equivalent circuit of FIG. 9 divides into $I^1$ and $I^2$ between $X_p$ and $a^2X_s$+$a^2R_1$. In turn the current $I^2$ through $a^2R_1$, i.e. the lamp load current, is set by the ratio of Xs to Xs+$a^2R_1$. The current through the reflected lamp impedance $a^2R_1$ in the equivalent circuit is converted in the actual ballast into lamp current $I^2$ through the lamp load by transformer action on the high voltage winding L3. In the example described above, the ratio of the reflected secondary winding impedance Xs to the reflected lamp load impedance $a^2R_1$ is equal to 8.0:

$$\text{Ratio figure: } \frac{X_s}{a^2R_l} = 8.0$$

Figure 10:
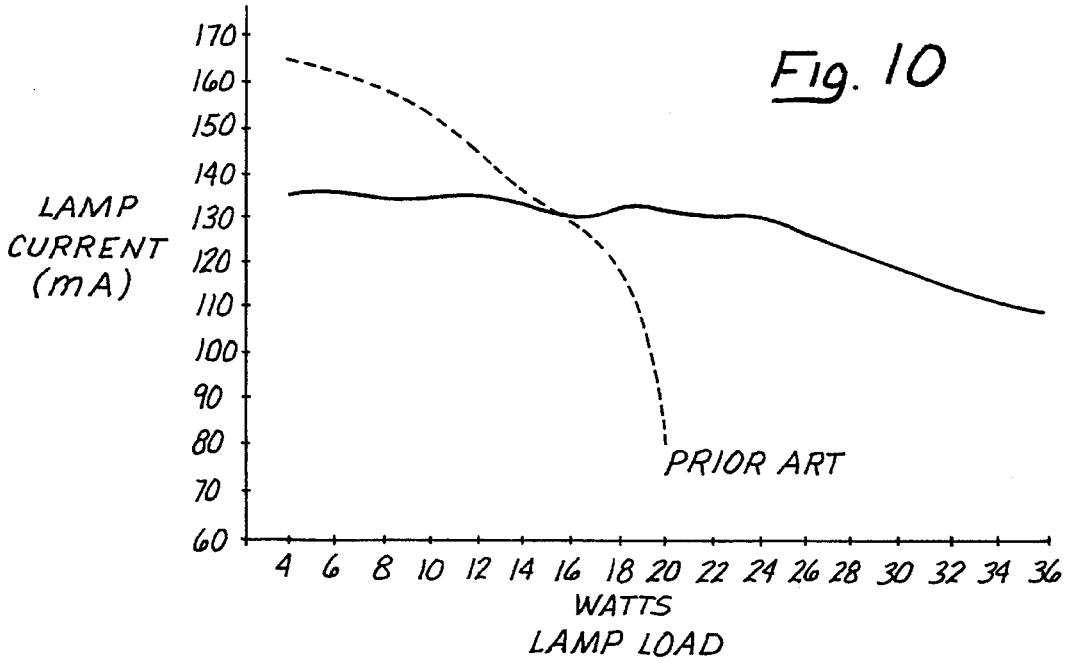
FIG. 10 is a graphical plot comparing current regulation as a function of lamp load for the improved and prior art ballasts.

Measurements plotted as the solid line curve in FIG. 10 show that this ratio figure results in superior load current regulation by the ballast 10. For a load range of 18 W to 4 W the load current varies by about 6 mA, or less than 5% of the rated 18 Watts lamp load current of 132 mA. At higher lamp load wattages, e.g. 36 Watts, the lamp current falls off substantially. The load regulation of the ballast 10 can be extended to a higher worst case load, such as 36 W, by constructing transformer T1 so as to increase the reflected leakage impedance Xs of the high voltage winding L3 sufficiently to maintain or increase the aforementioned ratio of 8 of $L_s$ (the reflected leakage inductance of L3) to $a^2R_1$ (the reflected lamp load impedance). Accordingly, for a worst case load of 36 Watts ($a^2R_1$ is double that of an 18 Watt lamp) the reflected leakage inductance of L3 must be doubled to achieve load current regulation comparable to that illustrated for the 18 Watts load in FIG. 10. In most ballast applications a load current regulation of 10% is acceptable, so that the aforementioned ratio may be somewhat smaller, and a ratio figure as small as 6.0, approximately corresponding to 10% load current regulation, is contemplated as a lower limit for the integrated magnetics universal ballast 10 of this invention. For purposes of this disclosure, load current regulation of 10% or better is considered to be an approximately constant current through the lamp load. Such degree of regulation is a substantial improvement over prior art ballasts of comparable design and complexity and lacking special current regulation features.

A practical method for achieving the sufficient ratio of reflected leakage inductance $L_s$ of the high voltage winding L3 involves the steps of 1) winding high voltage secondary L3 of ballast transformer T1 to produce an open circuit voltage greater than required to strike the lamp load, 2) connecting the ballast 10 to the selected worst case, i.e highest wattage fluorescent lamp load, 3) measuring the lamp current through the lamp load, 4) adjusting the number of turns on both the primary L1 and high voltage secondary L3 windings while maintaining constant the turns ratio between the two windings until the desired lamp current $I_2$ is achieved, and 5) measuring the ratio of reflected secondary winding impedance to reflected lamp load impedance as described above. If the ratio is less than the target figure, e.g. 8.0, then the high voltage secondary L3 to primary L1 turns ratio is increased and the process repeated beginning at step 2, until the target ratio figure of $X_s$ to $a^2R_1$ at the load current $I_2$ required by the lamp load is met or exceeded.

The dotted line curve in FIG. 10 shows load current regulation of a prior art ballast marketed for aircraft cabin lighting applications featuring a resonant tank circuit on the primary side of the transformer, but in which the winding of the ballast transformer was not optimized to enhance reflected leakage inductance. The load current supplied by the prior art ballast is seen to vary widely for a load range of 4 Watts to 18 Watts, and cannot be used with loads significantly other than 18 Watts, for which it was designed. The current industry practice is to design a ballast for each particular lamp load being powered, since no currently available ballasts are capable of regulating the load current sufficiently to achieve satisfactory wide load range operation.

In addition to the superior load current regulation offered by the improved ballast 10 of this invention, the ballast also features protection against short circuit conditions of lamp filaments and shorted lamp tubes. The enhanced reflected leakage inductance $X_s$ of the transformer T1 acts as a large source impedance in series with the lamp load. Consequently, current through a shorted lamp tube is limited to a safe value by the reflected leakage inductance of L3, which current can be safely dissipated in the high voltage winding L3 by appropriate design of the transformer, such as by packing of the secondary winding for heat sinking, or other known power dissipation techniques.

Likewise, shorted lamp filaments increase the power dissipation in the secondary filament windings, but do not appreciably affect voltage, current or frequency in the LC resonant tank due to the aforementioned limiting effect of the reflected leakage inductance of L3. The increased filament winding current can be managed by proper sizing of the filament winding wires, for example.

It will be appreciated that this short circuit protection is achieved without complex "foldback" current limiting circuitry, nor with additional current limiting impedance components on every transformer output, as is the current practice in the industry.

Another important advantage of this ballast circuit is an inherent lamp filament power reduction which occurs upon striking of the lamp tube load. As earlier described, the tank circuit $L_1C_2$ initially resonates at a frequency of 28 Kilohertz, before the lamp load is struck. In this initial condition, the filament windings L4–L6 supply a sufficient voltage to heat up the filaments of the lamp load. After this occurs, the lamp tubes strike and current flows through the high voltage secondary winding L3, placing the reflected leakage inductance Ls of the high voltage winding L3 in parallel with the primary winding L1, as in the equivalent circuit of FIG. 8. As explained, this causes a substantial shift in the resonant frequency of $L_1C_2$, to an operating frequency of about 20 Kilohertz in the present example. The lower frequency results in an increased voltage drop across the leakage inductance of the filament windings L4–L6, which is in series with the lamp filaments. This voltage drop causes the filament voltage to be reduced, to an operating filament voltage of approximately 1.5 volts. Once the lamp load strikes it is unnecessary to continue heating the filaments, and reducing filament voltage helps prevent blackening of the ends in small diameter lamp tubes, such as the T5 tubes used in aircraft cabin lighting applications. Again, this effect is achieved without need for additional circuitry or components, but rather as a result of the integrated magnetics approach to the design of transformer T1.

Still another feature of this ballast is the ability to start up and operate the lamp load at temperatures down to minus 15 degrees Centigrade. The high frequency voltage applied to the unstruck lamp load appears across the stray capacitance present between the lamp ends and the luminaire, designated by Lu in FIGS. 1 and 2, which is a conventional component of fluorescent light fixtures. The high frequency of the filament current coupled with the strike capacitance acts to move gas ions in the lamp tube towards the luminaire, thus aiding in lamp start-up. This assistance provided by the high frequency power reduces the strike voltage of the fluorescent lamps, thereby reducing the dielectric stress on transformer T1.

While a preferred embodiment has been described for purposes of example and illustration, it must be understood that many changes, substitutions and modifications to the described embodiment will be apparent to those possessed of ordinary skill in the art without thereby departing from the scope and spirit of the present invention, which is defined by the following claims.

What is claimed is:

1. A ballast circuit for driving one or more fluorescent lamps constituting a fluorescent lamp load, comprising:

a transformer having a primary winding coupled to a secondary winding means by a magnetic core;

an inverter circuit including a resonant tank circuit wherein said primary winding constitutes the sole inductive load of said inverter;

said secondary winding including filament windings for supplying current to cathode filaments of said lamps and a high voltage winding for supplying a lamp current to said lamps;

characterized in that said transformer is physically constructed, configured and arranged to enhance the leakage inductance of said secondary winding sufficiently to obtain a reflected impedance of said high voltage winding upon said primary winding at least 6.5 times greater than the reflected impedance upon said primary winding of a selected maximum fluorescent lamp wattage load, thereby to maintain said lamp current approximately constant for lamp wattage loads smaller than said selected maximum over a range of lamp load wattages of at least 3 to 1.

2. The ballast of claim 1 wherein said filament winding means comprise first and second filament windings in series with and at opposite ends of said high voltage winding, and a third filament winding.

3. The ballast of claim 1 wherein said magnetic core means is non-saturating and said primary and secondary winding means are wound as axially spaced bobbins on said magnetic core means to obtain said reflected impedance.

4. The ballast of claim 1 wherein said high voltage winding has a number of turns substantially greater than required to produce a voltage sufficient to strike a fluorescent lamp load constituting said maximum lamp wattage load.

5. The ballast of claim 1 wherein said primary and secondary winding means each are mounted on a corresponding one of two magnetic E-cores comprising said core means, said E-cores being joined end to end for coupling said primary and secondary winding means, there being a magnetic gap between opposing ends of center fingers of said E-cores thereby to keep said core means from magnetic saturation.

6. A ballast circuit for driving a fluorescent lamp load, comprising current inverter means driving a parallel resonant tank circuit consisting of a primary power winding of a power transformer and capacitor means connected to said primary power winding, said transformer including filament power supply means for heating cathode filaments of a fluorescent lamp load and high voltage secondary means for supplying a lamp current to said fluorescent lamp load, characterized in that the effective impedance of said primary power winding including the reflected impedance of said secondary means upon said primary power winding provides an effective source impedance in series with said lamp load of a magnitude sufficient to regulate the current through said lamp load to within 10% for any lamp load from 4 Watts to at least 36 Watts.

7. The ballast of claim 6 wherein said current inverter means include a two transistor drive circuit self-resonant at an ultrasonic frequency characterized by a higher resonant frequency in an initial unlit condition of said lamp load and a lower resonant frequency in a lit condition of said lamp load, such that said filament power supply means deliver a higher warm-up voltage to filaments of said lamp load and then a lower operating voltage to said filaments in said lit condition of said lamp load.

8. The ballast of claim 6 wherein the current through said lamp load remains regulated to within 10% in a short circuit condition of either said cathode filaments or said fluorescent lamp load.

9. A ballast circuit for driving a fluorescent lamp load, comprising current inverter means driving a parallel resonant tank circuit wherein the sole inductive component is a primary winding of a power transformer and capacitor means connected to said primary winding, said transformer including filament power supply means for heating cathode filaments of a fluorescent lamp load and a high voltage secondary winding for supplying a lamp current to said fluorescent lamp load;

characterized in that said primary winding and said high voltage winding are wound on separate axially spaced bobbins on said magnetic core for enhancing the leakage inductance of said transformer such that the reflected impedance of said high voltage winding upon said primary winding in a lit condition of said lamp load is at least 8 times greater than the reflected impedance of the lamp load upon said primary winding.

10. A method for achieving improved load current regulation for a maximum selected lamp load and any lamp load lesser than said selected lamp load in a fluorescent lamp ballast of the type having a power inverter with a step-up transformer and operating at a resonant frequency of a tank circuit consisting of a primary winding of said transformer :and capacitor means connected to said primary winding, said transformer having a secondary high-voltage winding connected across a fluorescent lamp load, said method comprising the steps of:

winding said primary winding and said high voltage winding as axially spaced windings on a transformer core comprised of two E-cores end-to-end gapped between center fingers of said E-cores; and selecting the wire and number of turns comprising each said winding such that the reflected impedance of said high voltage winding upon said primary winding in a lit condition of said lamp load is at least 6.5 times greater than the reflected impedance of the selected maximum lamp load upon said primary winding.

* * * * *